US012397188B1

(12) United States Patent
Wang

(10) Patent No.: US 12,397,188 B1
(45) Date of Patent: Aug. 26, 2025

(54) WEIGHT-ADJUSTABLE DUMBBELL

(71) Applicant: Hao's fitness equipment (Shanghai) Co., Ltd. TRADING LTD., Shanghai (CN)

(72) Inventor: Lihui Wang, Shanghai (CN)

(73) Assignee: Hao's fitness equipment (Shanghai) Co., Ltd. TRADING LTD., Shanghai (CN)

( * ) Notice: Subject to any disclaimer, the term of this patent is extended or adjusted under 35 U.S.C. 154(b) by 0 days.

(21) Appl. No.: 19/080,903

(22) Filed: Mar. 16, 2025

(30) Foreign Application Priority Data

Nov. 18, 2024 (CN) ..... 202422798031.8
Feb. 24, 2025 (CN) ..... 202520299205.8

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/0726; A63B 21/0728; A63B 21/072–075
See application file for complete search history.

(56) References Cited

U.S. PATENT DOCUMENTS 11,040,236 B1 * 6/2021 Chen ..... A63B 21/0728
11,191,993 B1 * 12/2021 Chen ..... A63B 21/075
11,642,565 B2 * 5/2023 Svenberg ..... A63B 21/00065 482/108
D1,052,014 S * 11/2024 Fu ..... D21/681
2009/0197745 A1 * 8/2009 Olson ..... A63B 21/075 482/107
2021/0187340 A1 * 6/2021 Chen ..... A63B 21/075
2021/0322817 A1 * 10/2021 Chen ..... A63B 21/0728

FOREIGN PATENT DOCUMENTS

CN 118236668 A * 6/2024 ..... A63B 21/0726

OTHER PUBLICATIONS

Translation of CN-118236668-A (Year: 2024).*

* cited by examiner

*Primary Examiner* — Megan Anderson
*Assistant Examiner* — Catrina A Letterman
(74) *Attorney, Agent, or Firm* — Ying-Ting Chen

(57) ABSTRACT

A weight-adjustable dumbbell includes: a handle, two ends of the handle respectively provided with a fixing plate; a plurality of dumbbell plates, respectively arranged sequentially along the fixing plate and movably connected to each other; a pair of first sliding slots, disposed on each of the plurality of dumbbell plates, and penetrating through each of the plurality of dumbbell plates; a pair of second sliding slots, disposed on each of the fixing plate and corresponding to the first sliding slots; and a pair of adjusting assemblies, where two ends of each of the adjusting assemblies are respectively connected to the two fixing plates and respectively corresponding to the two first sliding slots of two of the plurality of dumbbell plates.

19 Claims, 10 Drawing Sheets

WEIGHT-ADJUSTABLE DUMBBELL

CROSS-REFERENCE TO RELATED APPLICATIONS

This application claims priority to Chinese Patent Application No. 202422798031.8, filed on Nov. 18, 2024, and Chinese Patent Application No. 202520299205.8, filed on Feb. 24, 2025, the contents of which are incorporated herein by reference in their entirety.

TECHNICAL FIELD

The present disclosure relates to the technical field of dumbbells, and more particularly to a weight-adjustable dumbbell.

BACKGROUND

As a kind of fitness equipment, dumbbells are widely used, and they can satisfy the needs of fitness enthusiasts. Due to the wide application of adjustable dumbbells, users often need many dumbbell plates of different weights, and adjustable dumbbells are frequently adjusted for different weights during using to meet training requirements.

The conventional technology discloses a weight-adjustable dumbbell, which comprises a plurality of dumbbell plates, a dumbbell rod assembly for hanging the dumbbell plates, and a bottom bracket for storing the dumbbell plates. The dumbbell rod assembly comprises a transmission shaft, a plurality of cam structures are fixedly connected on the transmission shaft, the cam structure comprises a cam plate, the cam plate comprises a load-bearing layer for hanging with the dumbbell plates, the outer layers on two sides of the load-bearing layer are respectively provided with anti-wear layers, and the outer surface of one side of the anti-wear layer is provided with a plurality of convex points. Two sides of the cam plate of the cam structure are provided with anti-wear layers, and the outer surface of one side of the anti-wear layer on is provided with bumps, the hardness of the anti-wear layer is lower than the hardness of the dumbbell plate, so that the wear of the cam plate on the dumbbell plate can be effectively reduced, the service life of the dumbbell plate can be prolonged, and the connection stability of the dumbbell plate can be improved. However, although the dumbbell in this technology solution is easy to adjust, the cam structure contours are different, and the cam accuracy is highly required, which makes the manufacturing process complicated and greatly increases the production cost. In addition, the dumbbell in this technology solution does not have a self-locking function.

SUMMARY

According to an embodiment of the present disclosure, a weight-adjustable dumbbell is provided and comprises:

- a handle, two ends of the handle respectively provided with a fixing plate;
- a plurality of dumbbell plates, respectively arranged sequentially along the fixing plate and movably connected to each other;
- a pair of second sliding slots, disposed on the fixing plate and corresponding to the first sliding slots;
- a pair of first sliding slots, disposed on the dumbbell plate and penetrating the dumbbell plate; and

- a pair of adjusting assemblies, where two ends of each of the adjusting assemblies are respectively connected to the two fixing plates and corresponding to the two first sliding slots respectively;
- where each of the adjusting assemblies comprises a hanging rod, a shell, a driving mechanism, and a limiting assembly;
- an outer side of the shell is provided with a connecting hole;
- the hanging rod is movably disposed inside the shell and slidably in the shell;
- the driving mechanism is disposed inside the connecting hole, movably connected to the shell through the connecting hole, and capable of driving the hanging rod to enter into the corresponding first sliding slot; and
- the limiting assembly is fixedly connected to the shell and matched with the driving mechanism to self-lock the driving mechanism.

Further, the driving mechanism comprises a rack, a gear, a pair of snapping hooks, a rotating shaft and a knob;

- the rack is connected to the hanging rod;
- the rotating shaft is detachably connected to the shell;
- the gear is sleeved on the rotating shaft, and the gear is meshed with the rack;
- a pair of snapping hooks are fixedly connected to the gears respectively, and the gears and the snapping hooks move synchronously; and
- the knob is rotatably sleeved on the rotating shaft, a pair of driving members are disposed on the knob, the driving members are connected to the snapping hooks, and the knob is rotated to drive the snapping hooks to move through the driving members.

Further, the limiting assembly comprises a limiting ring, the limiting ring is fixedly connected to the shell, an inner ring of the limiting ring is sequentially provided with a plurality of limiting protrusions along a circumferential direction, the limiting protrusions are arc-shaped and gradually thicken;

- each of the snapping hooks comprises a connecting portion, an elastic portion, and a hook-shaped portion;
- the connecting portion is fixedly connected to the gear, and the connecting portion, the elastic portion, and the hook-shaped portion are sequentially connected;
- an outer side of the elastic portion is provided with a snapping portion, and the snapping portion is matched with the limiting protrusion; and
- the hook-shaped portion and the connecting portion cooperate with the driving member.

Further, the elastic portion is arc-shaped, and an opening between the elastic portion and the hook-shaped portion is V-shaped from a connection and gradually increases.

Further, the hanging rod is provided with a long slot, the rack and the gear are disposed inside the long slot, and the rotating shaft penetrates the long slot.

Further, the shell is provided with a pound value marker, and the pound value marker is arranged along a circumferential direction of the knob.

Further, a top of the hanging rod is provided with a pound value marker, the shell is provided with a marker observation window, and the marker observation window corresponds to the pound value marker.

Further, a plurality of positioning slots are evenly disposed at a bottom of the shell, a plurality of elastic plungers are disposed at a bottom of the hanging rod, and the elastic plungers are matched with the positioning slots.

Further, two sides of the upper end of each of the dumbbell plates are respectively provided with a first upper hanging protrusion and a first upper hanging slot, two sides of a lower end of each of the dumbbell plates are respectively provided with a first lower hanging protrusion and a first lower hanging slot, the first upper hanging protrusion and the first lower hanging protrusion are disposed on different sides of the dumbbell plate.

Further, the upper end of the fixing plate, on a side close to the dumbbell plates, is provided with a second upper hanging slot coupled with the first upper hanging protrusion, and the lower end is provided with a second lower hanging protrusion coupled with the first lower hanging slot.

Further, two sides of the upper end of the dumbbell plate are respectively provided with a first positioning hole and a third upper hanging slot, and a first hanging member is detachably disposed inside the first positioning hole; two sides of the lower end of the dumbbell plate are respectively provided with a second positioning hole and a second lower hanging slot, and a second hanging member is detachably disposed inside the second positioning hole; the first hanging member and the second hanging member are disposed on different sides of the dumbbell plate.

Further, the upper end of the fixing plate, on a side close to the dumbbell plates, is provided with a third positioning hole, a third hanging member coupled with the third upper hanging slot is detachably disposed inside the third positioning hole, and the lower end is provided with a third lower hanging slot coupled with the second hanging member.

According to the weight-adjustable dumbbell of the embodiment of the disclosure, the weight can be quickly selected, and the structure is stable. The dumbbell has a self-locking function to prevent plates from falling off, and also has a low requirement for production precision, simple manufacture, and greatly reduced production cost.

It is understood that both the foregoing general description and the following detailed description are exemplary and are intended to provide further illustration of the claimed technology.

DETAILED DESCRIPTION OF THE EMBODIMENTS

Figure 1:
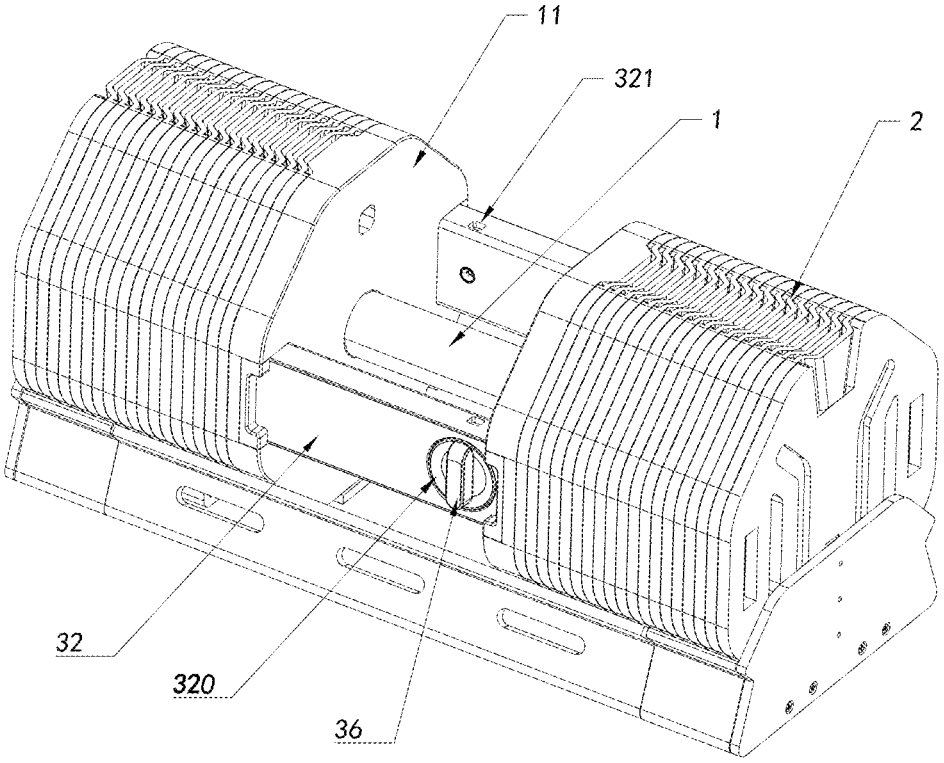
FIG. 1 is a schematic perspective view of a weight-adjustable dumbbell according to an embodiment of the present disclosure.

The following will be combined with the accompanying drawings, the embodiments of the present disclosure will be described in detail, and the present disclosure will be further illustrated.

First, the weight-adjustable dumbbell according to the embodiment of the present disclosure will be described with reference to FIGS. 1 to 18, which is used in fitness training and applied in a very wide scenario.

As shown in FIGS. 1 to 18, the weight-adjustable dumbbell according to the embodiment of the present disclosure, comprises:

- a handle 1, two ends of the handle 1 respectively provided with a fixing plate 11;
- a plurality of dumbbell plates 2, where the plurality of dumbbell plates 2 are disposed at two ends of the handle 1, respectively arranged sequentially along the fixing plate 11, and movably connected to each other;
- a pair of first sliding slots 21, disposed on each of the dumbbell plates 2, where the first sliding slots 21 penetrate the dumbbell plate 2, each of the dumbbell plates 2 is provided with a pair of first sliding slots 21, so that the dumbbell plates 2 can be placed at two ends of the handle 1 and can be turned upside down;
- a pair of second sliding slots 110, corresponding to the pair of first sliding slots 21, disposed on the fixing plate 11, and penetrating the fixing plate 11; and
- a pair of adjusting assemblies 3, where two ends of each of the adjusting assemblies 3 are respectively connected to the two fixing plates 11 at two ends of the handle 1, correspond to two first sliding slots 21 of two dumbbell plates 2 at two ends of the handle 1, and correspond to two second sliding slots 110 of two fixing plates 11 at two ends of the handle 1, respectively.

Each of the adjusting assemblies 3 comprises a hanging rod 31, a shell 32, a driving mechanism, and a limiting assembly.

The outer side of the shell 32 is provided with a connecting hole 320.

The hanging rod 31 is movably disposed inside the shell 32 and slidable inside the shell 32, where the shell 32 plays a role of supporting and protecting the dumbbell plate 2.

The driving mechanism is disposed inside the connecting hole 320, and is movably connected to the shell 32 through the connecting hole 320, and can drive the hanging rod 31 to enter the corresponding first sliding slot 21 from the second sliding slot 110, and when the hanging rod 31 enters the first sliding slot 21, the lifting handle 1 can lift the corresponding dumbbell plate 2.

The limiting assembly is fixedly connected to the shell 32 and cooperates with the driving mechanism for self-locking of the driving mechanism.

Further, as shown in FIGS. 1, 4 to 5, and 16 to 18, in the present embodiment, the driving mechanism comprises: a rack 33, a gear 34, a rotating shaft 35, a knob 36, and a pair of snapping hooks 30.

The rack 33 is connected to the hanging rod 31.

The rotating shaft 35 is detachably and stably connected to the shell 32.

The gear 34 is sleeved on the rotating shaft 35, and the gear 34 is meshed with the rack 33.

A pair of snapping hooks 30 are fixedly connected to the gear 34 respectively, and the gear 34 moves synchronously with the snapping hooks 30.

The knob 36 is rotatably sleeved on the rotating shaft 35, a pair of driving members 361 are disposed on the knob 36, the pair of driving members 361 are connected to the pair of snapping hooks 30, the knob 36 can drive the pair of snapping hooks 30 to move through the pair of driving members 361, the pair of snapping hooks 30 drive the gear 34 to move synchronously, the gear 34 drives the rack 33 and the hanging rod 31 to move in opposite directions to make the hanging rod 31 enter into the dumbbell plate 2 at one end of the handle 1.

Figure 16:
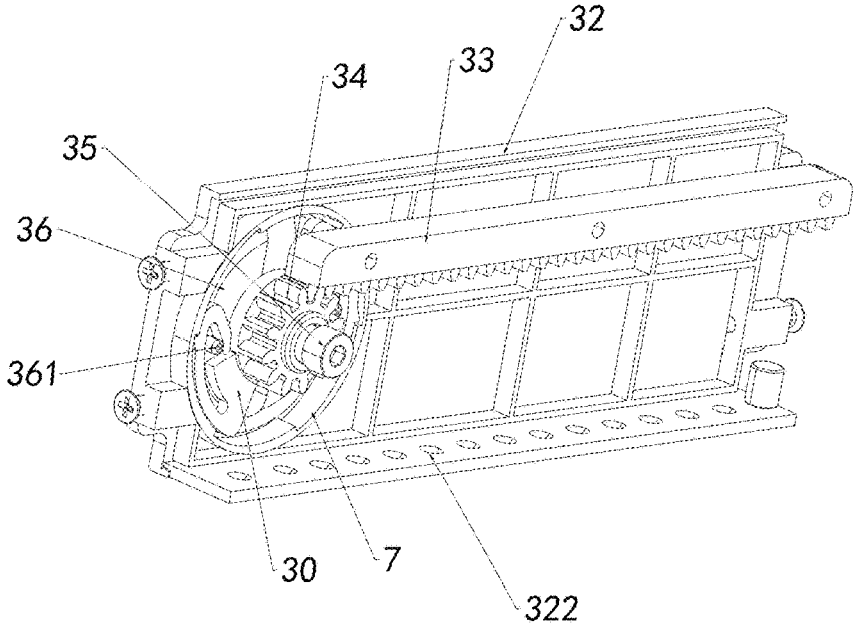
FIG. 16 is a schematic diagram of the internal structure of the adjusting assembly according to the embodiment of the present disclosure.
Figure 17:
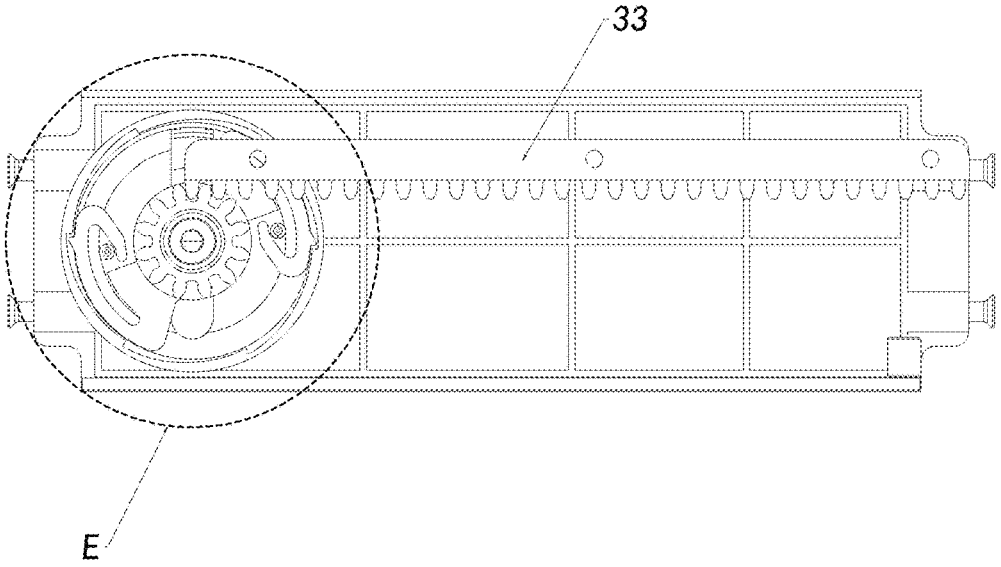
FIG. 17 is a right view of FIG. 14.
Figure 18:
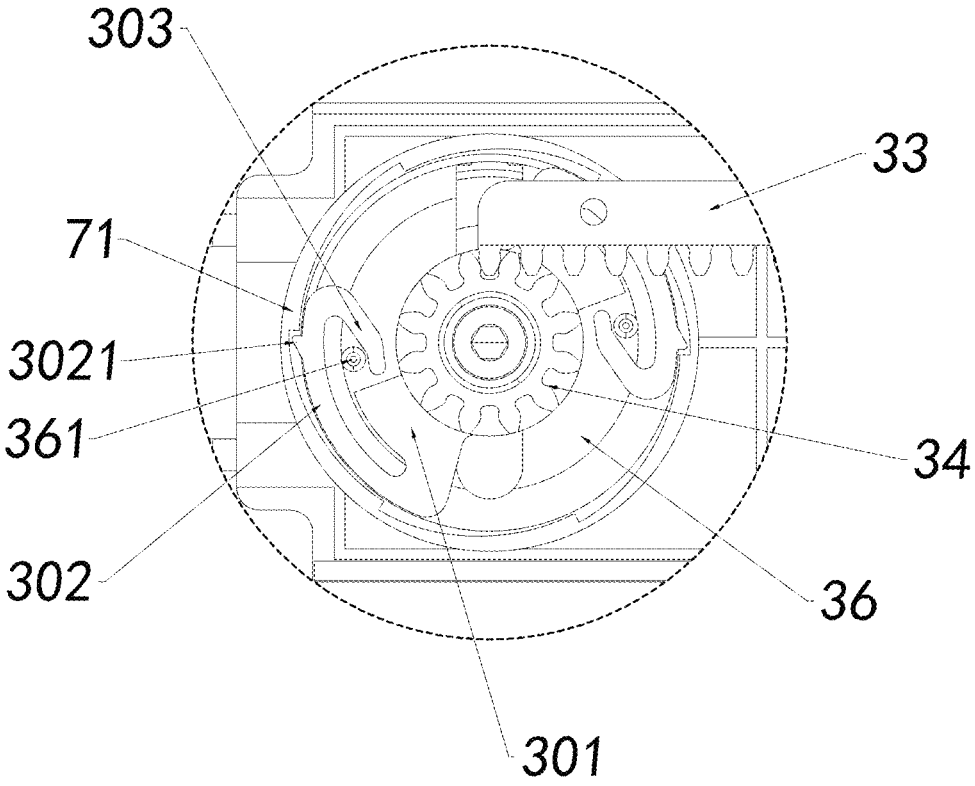
FIG. 18 is an enlarged view at E of FIG. 15.

Further, as shown in FIGS. 16 and 18, in the present embodiment, the limiting assembly comprises: a limiting ring 7, the limiting ring 7 is fixedly connected to the shell 32, an inner ring of the limiting ring 7 is provided with a plurality of limiting protrusions 71 sequentially along a circumferential direction, and the limiting protrusions 71 are arc-shaped and gradually thicken.

Each of the snapping hooks 30 comprises a connecting portion 301, an elastic portion 302, and a hook-shaped portion 303.

The connecting portion 301 is fixedly connected to the gear 34. The connecting portion 301, the elastic portion 302, and the hook-shaped portion 303 are connected sequentially.

An outer side of the elastic portion 302 is provided with a snapping portion 3021, and the snapping portion 3021 is matched with the limiting protrusion 71.

Further, as shown in FIG. 18, in the present embodiment, the elastic portion 302 is arc-shaped, an opening between the elastic portion 302 and the hook-shaped portion 303 is V-shaped from a connection point and gradually increases, and the elastic portion 302 is made of an elastic material, so that elastic deformation can occur to a certain extent.

When the driving member 361 follows the forward rotation of the knob 36, the driving member 361 contacts the connecting portion 301 and drives the connecting portion 301 to rotate. When the connecting portion 301 is rotated by each unit angle, the snapping portion 3021 is engaged with the corresponding limiting protrusion 71, so that self-locking is generated between the snapping portion 3021 and the limiting protrusion 71 after the rotation of the knob 36 is stopped, so that the gear 34 and the rack 33 are in a self-locking state, and the plates falling off is prevented during training. When the driving member 361 follows the reverse rotation of the knob 36, the driving member 361 first moves away from the connecting portion 301, then enters the opening between the elastic portion 302 and the hook-shaped portion 303, and gradually contacts the hook-shaped portion 303. Then, the driving member 361 drives the hook-shaped portion 303 and the elastic portion 302 to move in the direction of the center of the rotating shaft until the snapping portion 3021 is disengaged from the limiting protrusion 71, and then the snapping hooks 30 can rotate together with the driving member 361 and the knob 36.

Figure 4:
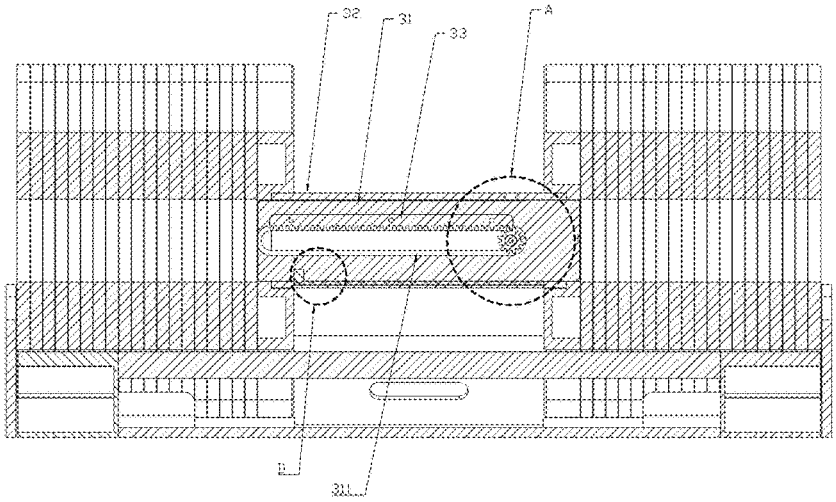
FIG. 4 is a cross-sectional view taken along line B-B of FIG. 2.
Figure 5:
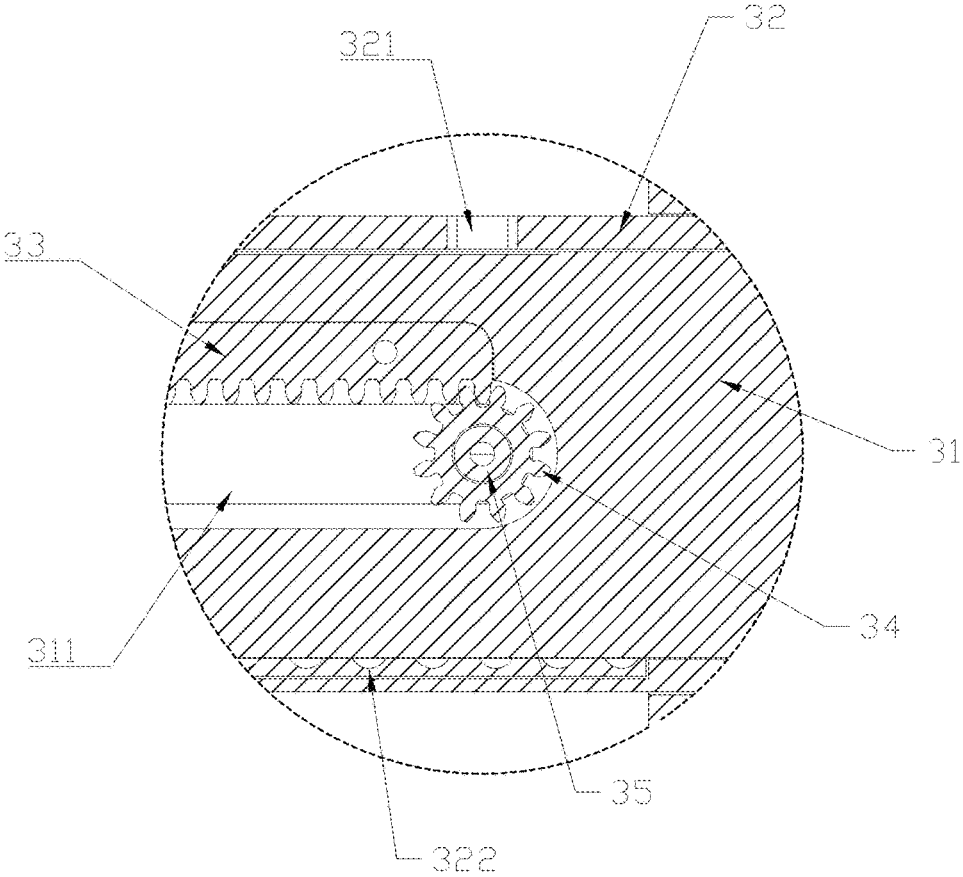
FIG. 5 is an enlarged view at A of FIG. 4.

Further, as shown in FIGS. 4 to 5, in the present embodiment, the hanging rod 31 is provided with a long slot 311, the rack 33 and the gear 34 are disposed inside the long slot 311, the rotating shaft 35 is vertical and penetrates the long slot 311, and the long slot 311 plays a role of guiding and limiting.

Further, in the present embodiment, the shell 32 is provided with a pound value marker. The pound value marker is arranged along the circumferential direction of knob 36. When the knob 36 is rotated to the corresponding pound value marker, the dumbbell plates 2 of the corresponding weight can be lifted by picking up the handle 1.

Figure 2:
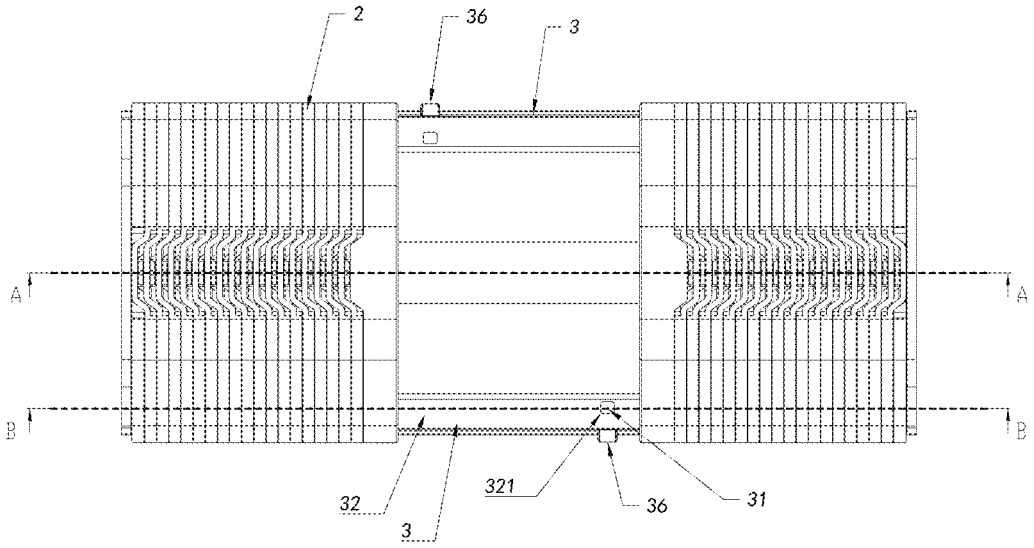
FIG. 2 is a top view of FIG. 1.
Figure 3:
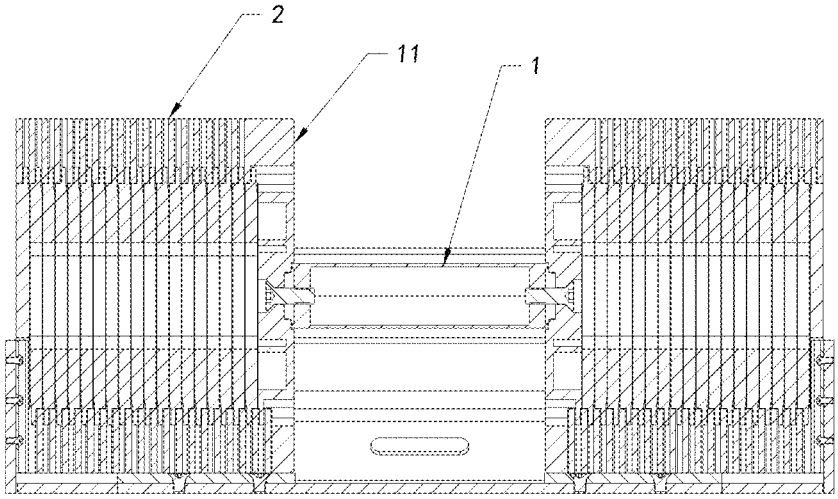
FIG. 3 is a cross-sectional view taken along line A-A of FIG. 2.

Further, as shown in FIGS. 1 to 2 and 5, in the present embodiment, the top of the hanging rod 31 is provided with a pound value marker. The shell 32 is provided with a marker observation window 321. The marker observation window 321 corresponds to the pound value marker. As the hanging rod 31 slides within the shell 32, the corresponding pound value marker appears in the observation window 321 for easy use to know the weight of the hanging.

Figure 6:
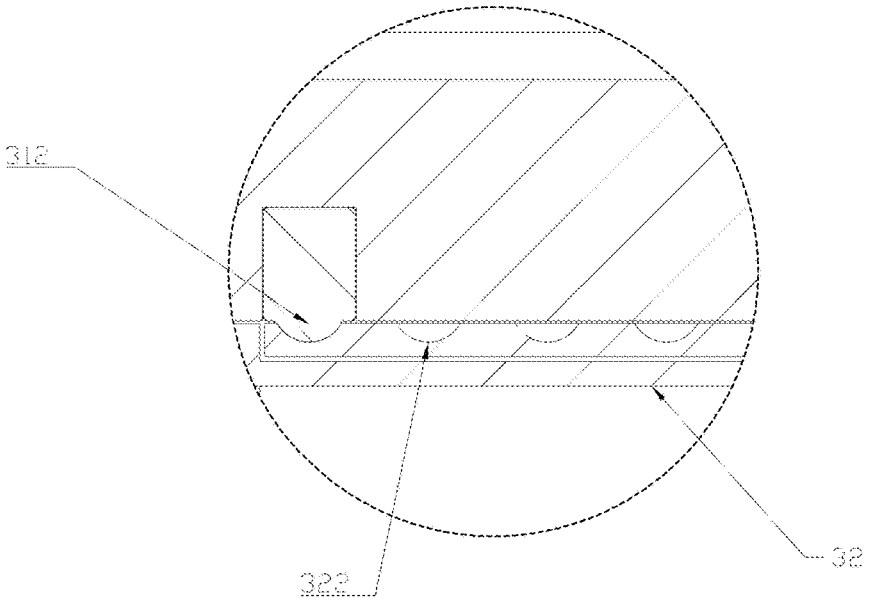
FIG. 6 is an enlarged view at D of FIG. 4.

Further, as shown in FIGS. 5 to 6, in the present embodiment, a plurality of positioning slots 322 are uniformly disposed at the bottom of the shell 32. An elastic plungers 312 is disposed at the bottom of the hanging rod 31. The elastic plungers 312 is matched with one of the positioning slots 322. When the elastic plungers 312 enters one of the positioning slots 322, a click sound is generated for a positioned prompt.

Figure 7:
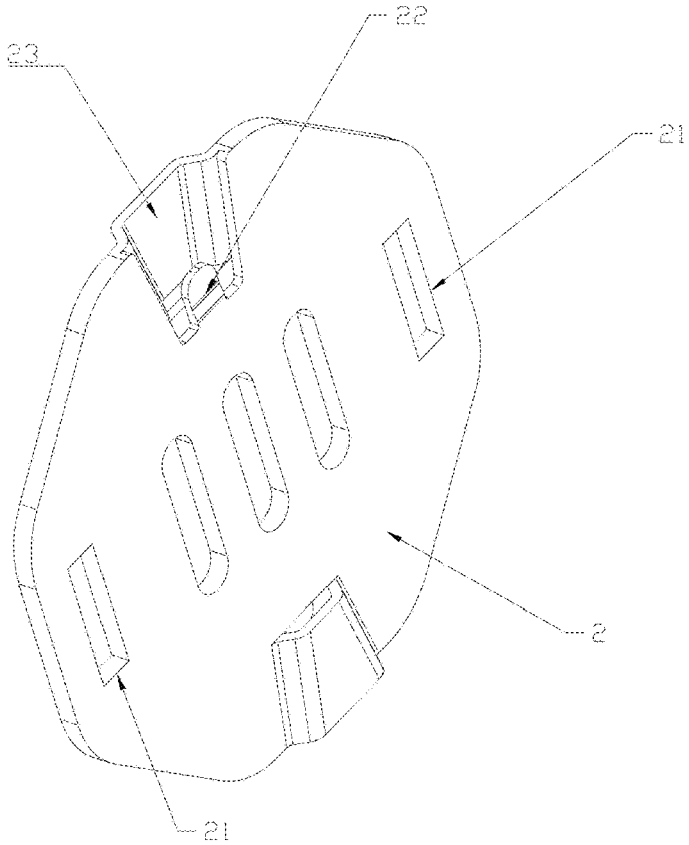
FIG. 7 is a schematic structural diagram of the dumbbell plate according to an embodiment of the present disclosure.
Figure 8:
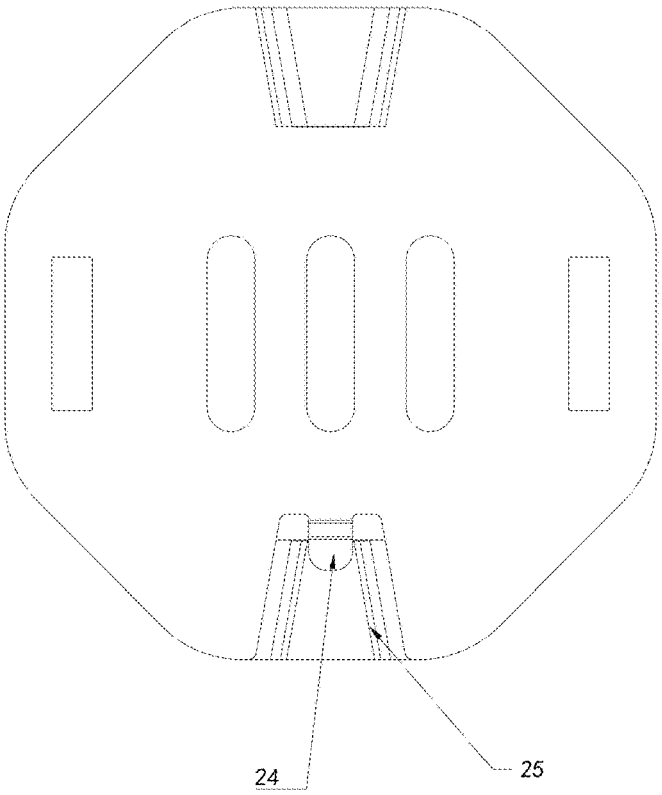
FIG. 8 is a rear view of FIG. 7.
Figure 9:
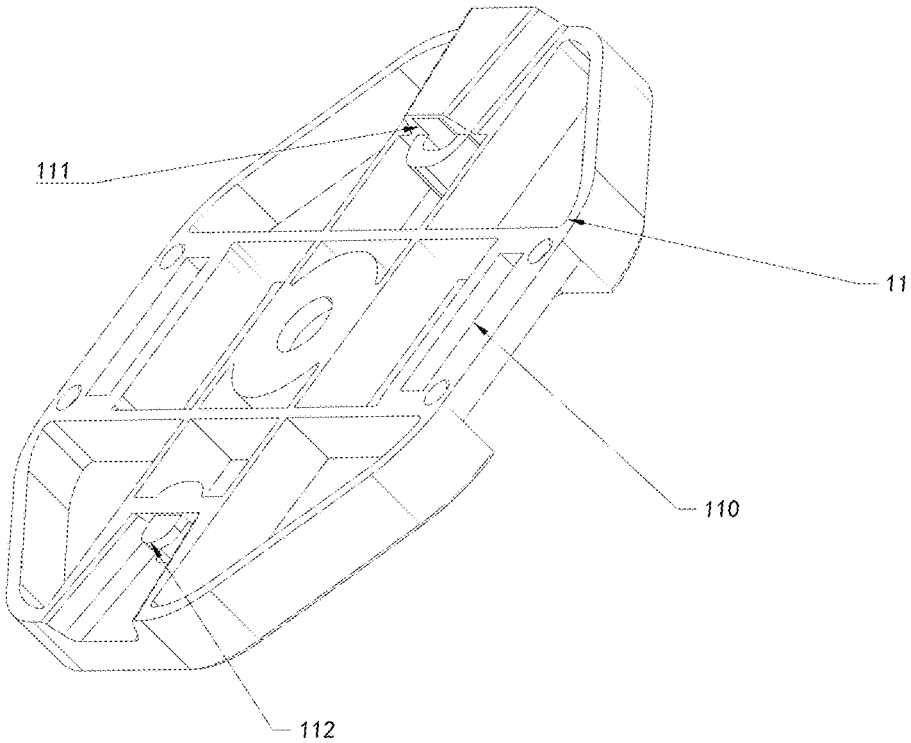
FIG. 9 is a schematic structural diagram of the fixing plate according to an embodiment of the present disclosure.
Figure 10:
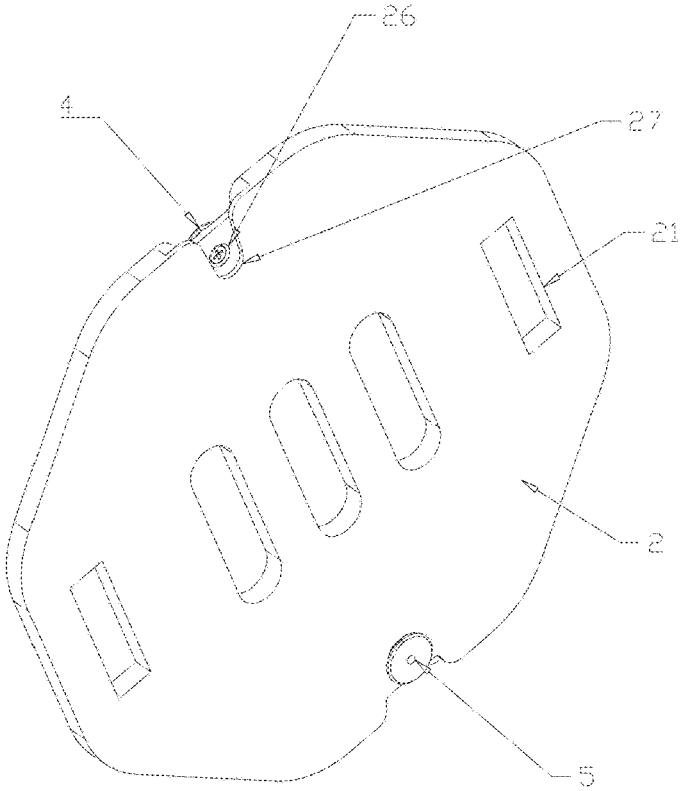
FIG. 10 is a schematic structural diagram of the dumbbell plate according to another embodiment of the present disclosure.
Figure 11:
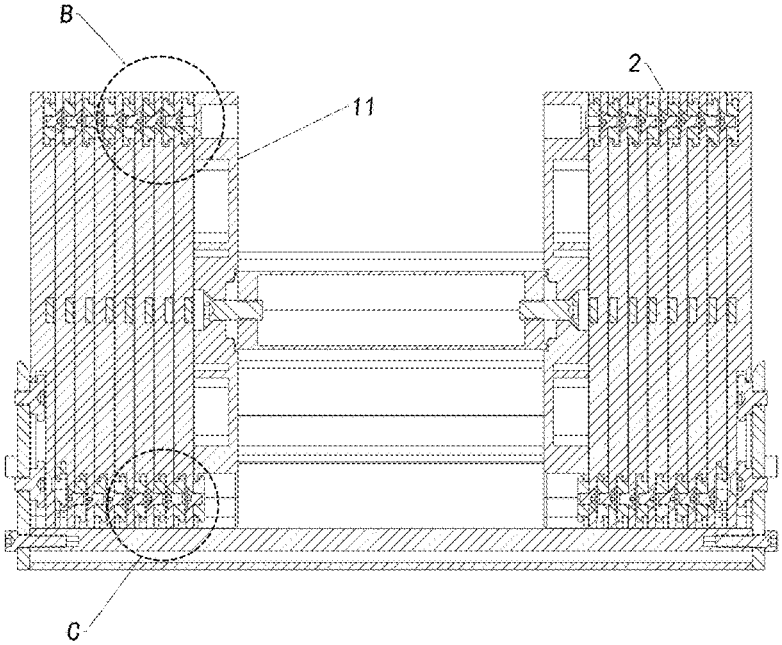
FIG. 11 is a cross-sectional view of the assembled dumbbell plates according to the embodiment of the present disclosure.
Figure 12:
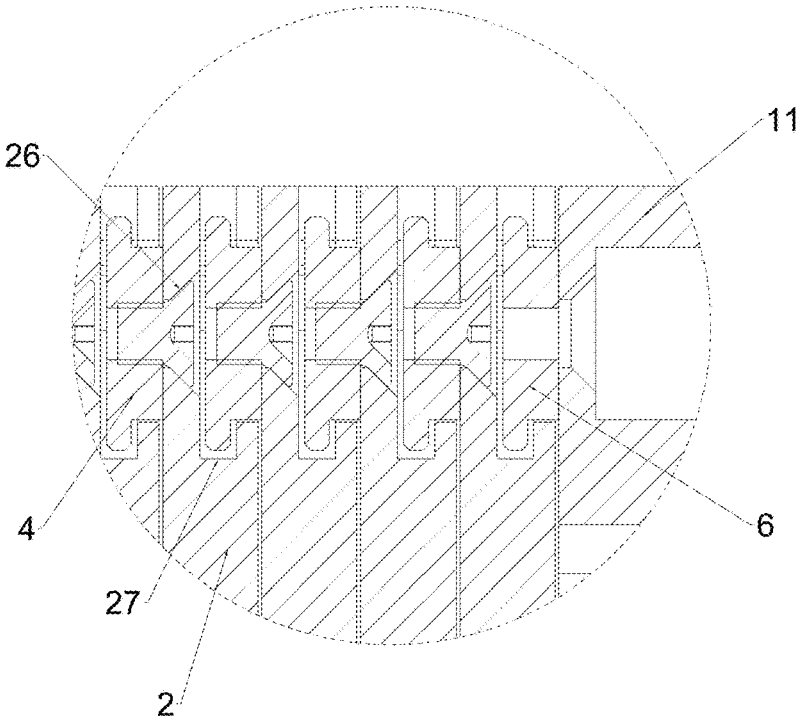
FIG. 12 is an enlarged view at B of FIG. 10.
Figure 13:
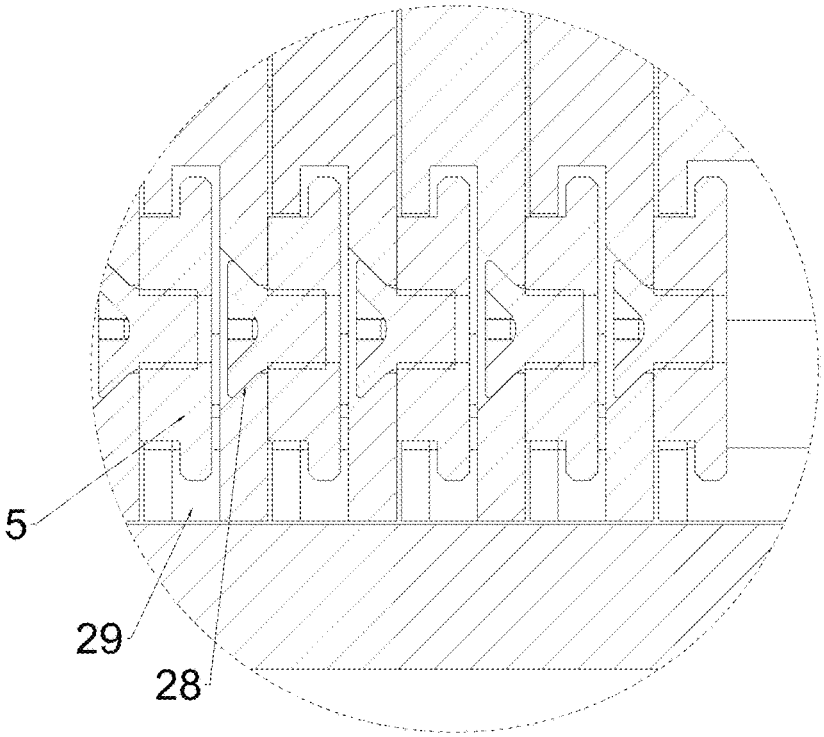
FIG. 13 is an enlarged view at C of FIG. 10.

Further, as shown in FIGS. 7 to 9, in the present embodiment, two sides of the upper end of the dumbbell plate 2 are respectively provided with a first upper hanging protrusion 22 and a first upper hanging slot 23. Two sides of the lower end of the dumbbell plate 2 are respectively provided with a first lower hanging protrusion 24 and a first lower hanging slot 25. The first upper hanging protrusion 22 and the first lower hanging protrusion 24 are provided on different sides of the dumbbell plate 2. Thus, the first upper hanging slot 23 of the inner dumbbell plate 2 is coupled with the first upper hanging protrusion 22 of the adjacent outer dumbbell plate 2, and the first lower hanging protrusion 24 of the inner dumbbell plate 2 is coupled with the first lower hanging slot 25 of the adjacent outer dumbbell plate 2. When the inner dumbbell plate 2 is lifted up, the outer dumbbell plate 2 will not be lifted, but when the outer dumbbell plate 2 is lifted up, the inner dumbbell plate 2 will be lifted by the hanging rod 31.

Further, as shown in FIG. 9, in the present embodiment, the upper end of the fixing plate 11, on the side close to the dumbbell plates 2, is provided with a second upper hanging slot 111 coupled with the first upper hanging protrusion 22. The lower end of the fixing plate 11, on the side close to the dumbbell plates 2, is provided with a second lower hanging protrusion 112 coupled with the first lower hanging slot 25.

Further, as shown in FIGS. 7 to 9, in the present embodiment, the first upper hanging protrusion 22, the first lower hanging protrusion 24, and the second lower hanging protrusion 112 have the same structure. The first upper hanging slot 23, the first lower hanging slot 25, and the second upper hanging slot 111 have the same structure.

Further, as shown in FIGS. 10 to 13, in the present embodiment, two sides of the upper end of the dumbbell plate 2 are provided with a first positioning hole 26 and a third upper hanging slot 27, respectively. The first hanging member 4 is detachably disposed inside the first positioning hole 26. Two sides of the lower end of the dumbbell plate 2 are respectively provided with a second positioning hole 28 and a second lower hanging slot 29. A second hanging member 5 is detachably disposed inside the second positioning hole 28. The first hanging member 4 and the second hanging member 5 are disposed on different sides of the dumbbell plate 2.

Figure 14:
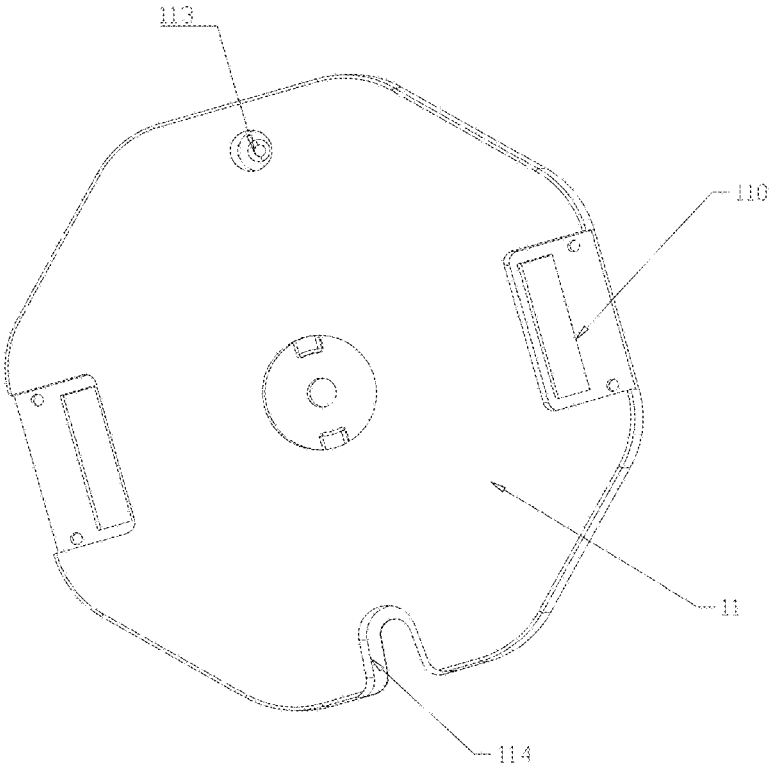
FIG. 14 is a schematic structural diagram of the fixing plate according to another embodiment of the present disclosure at a first viewing angle.
Figure 15:
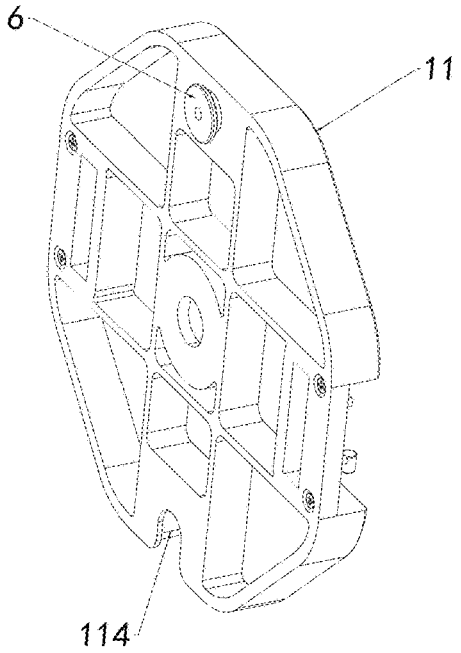
FIG. 15 is a schematic structural diagram of the fixing plate according to the embodiment of the present disclosure at a second viewing angle.

Further, as shown in FIGS. 14 to 15, in the present embodiment, the upper end of the fixing plate 11, on the side close to the dumbbell plates 2, is provided with a third positioning hole 113. The third positioning hole 113 is detachably provided with a third hanging member 6 coupled with the third upper hanging slot 27. The lower end of the fixing plate 11, on the side close to the dumbbell plates 2, is provided with a third lower hanging slot 114 coupled with the second hanging member 5.

Further, as shown in FIGS. 10 to 15, in the present embodiment, the first hanging member 4, the second hanging member 5, and the third hanging member 6 have the same structure. The third upper hanging slot 27, the second lower hanging slot 29, and the third lower hanging slot 114 have the same structure.

Working principle: rotating the knob 36 according to the requirement to make the hanging rod 31 extend a certain length, so that when lifting up the handle 1, the dumbbell plates 2 within the extended length range of the hanging rod 31 are lifted up. Further, the extended lengths of the two hanging rods 31 can be selected to be the same or different. The snapping hooks 30 act to drive the movement of the gear 34 and to self-lock the gear 34.

As above, as shown in FIGS. 1 to 18, according to the weight-adjustable dumbbell of the embodiment of the disclosure, the weight can be quickly selected, and the structure is stable. The dumbbell has a self-locking function to prevent plates from falling off, and it also has a low requirement for production precision, simple manufacture, and greatly reduced production cost.

It should be noted that in this specification, the terms "include," "comprise," or any other variation thereof are intended to encompass a non-exclusive inclusion such that a process, method, article, or apparatus that comprises a series of elements comprises not only those elements, but also other elements that are not explicitly listed, or elements inherent to such a process, method, article, or apparatus. Without further limitation, an element defined by the statement "comprise" does not preclude the presence of additional identical elements in a process, method, article, or apparatus that comprises the element.

Although the contents of the present invention have been described in detail by way of the above preferred embodiments, it should be recognized that the above description should not be regarded as limiting the present disclosure. Various modifications and alternatives to the present disclosure will be apparent to those skilled in the art after reading the above. Therefore, the scope of protection of the present disclosure should be defined by the appended claims.

What is claimed is:

1. A weight-adjustable dumbbell, comprising:

a handle, two ends of the handle respectively provided with a fixing plate;

a plurality of dumbbell plates, respectively arranged sequentially on the fixing plate and movably connected to each other;

a pair of first sliding slots, disposed on each of the plurality of dumbbell plates, and penetrating through each of the plurality of dumbbell plates;

a pair of second sliding slots, disposed on each of the fixing plate and corresponding to the first sliding slots; and a pair of adjusting assemblies, wherein two ends of each of the adjusting assemblies are respectively connected to the two fixing plates and respectively corresponding to the pair of first sliding slots of two of the plurality of dumbbell plates;

wherein each of the pair of adjusting assemblies comprises a hanging rod, a shell, a driving mechanism, and a limiting assembly;

an outer side of the shell is provided with a connecting hole;

the hanging rod is movably disposed inside the shell and slidable in the shell;

the driving mechanism is disposed inside the connecting hole, movably connected to the shell through the connecting hole, and capable of driving the hanging rod to correspondingly enter into one of the pair of first sliding slots; and the limiting assembly is fixedly connected to the shell and matched with the driving mechanism to self-lock the driving mechanism;

wherein the driving mechanism comprises:

a rack, connected to the hanging rod;

a rotating shaft, detachably connected to the shell;

a gear, sleeved on the rotating shaft, wherein the gear is meshed with the rack;

a pair of snapping hooks, fixedly connected to the gear respectively, wherein the gear and the pair of snapping hooks move synchronously; and a knob, rotatably sleeved on the rotating shaft, wherein a pair of driving members are disposed on the knob, connected to the pair of snapping hooks, and are protrusions extending from an inner surface of the knob, wherein the knob is rotated to drive the pair of snapping hooks to move through the pair of driving members;

wherein the limiting assembly comprises a limiting ring, the limiting ring is fixedly connected to the shell, an inner ring of the limiting ring is sequentially provided with a plurality of limiting protrusions along a circumferential direction.

2. The weight-adjustable dumbbell according to claim 1, wherein the limiting protrusions are arc-shaped and gradually thicken;

each of the snapping hooks comprises a connecting portion, an elastic portion, and a hook-shaped portion;

the connecting portion is fixedly connected to the gear, and the connecting portion, the elastic portion, and the hook-shaped portion are sequentially connected; and an outer side of the elastic portion is provided with a snapping portion, and the snapping portion is matched with the limiting protrusion.

3. The weight-adjustable dumbbell according to claim 2, wherein the elastic portion is arc-shaped, and an opening between the elastic portion and the hook-shaped portion is V-shaped from a connection point and gradually increases.

4. The weight-adjustable dumbbell according to claim 2, wherein a plurality of positioning slots are uniformly disposed at the bottom of the shell, an elastic plunger is disposed at the bottom of the hanging rod, and the elastic plunger is matched with one of the plurality of positioning slots.

5. The weight-adjustable dumbbell according to claim 2, wherein two sides of an upper end of each of the plurality of dumbbell plates are respectively provided with a first upper hanging protrusion and a first upper hanging slot, two sides of a lower end of each of the plurality of dumbbell plates are respectively provided with a first lower hanging protrusion and a first lower hanging slot, and the first upper hanging protrusion and the first lower hanging protrusion are disposed on different sides of each of the plurality of dumbbell plates.

6. The weight-adjustable dumbbell according to claim 5, wherein an upper end of each of the fixing plates, on a side close to the plurality of dumbbell plates, respectively, is provided with a second upper hanging slot coupled with the first upper hanging protrusion, and a lower end of each of the fixing plates, on the side close to the plurality of dumbbell plates, respectively, is provided with a second lower hanging protrusion coupled with the first lower hanging protrusion.

7. The weight-adjustable dumbbell according to claim 2, wherein two sides of an upper end of each of the plurality of dumbbell plates are respectively provided with a first positioning hole and a third upper hanging slot, a first hanging member is detachably disposed inside the first positioning hole, two sides of a lower end of each of the plurality of dumbbell plates are respectively provided with a second positioning hole and a second lower hanging slot, a second hanging member is detachably disposed inside the second positioning hole, and the first hanging member and the second hanging member are disposed on different sides of each of the plurality of dumbbell plates.

8. The weight-adjustable dumbbell according to claim 7, wherein an upper end of each of the fixing plates, on a side close to the plurality of dumbbell plates, respectively, is provided with a third positioning hole, a third hanging member coupled with the third upper hanging slot is detachably disposed inside the third positioning hole, a lower end of each of the fixing plates, on the side close to the plurality of dumbbell plates, respectively, is provided with a third lower hanging slot coupled with the second hanging member.

9. The weight-adjustable dumbbell according to claim 1, wherein a long slot is disposed on the hanging rod, the rack and the gear are disposed inside the long slot, and the rotating shaft penetrates the long slot.

10. The weight-adjustable dumbbell according to claim 9, wherein a plurality of positioning slots are uniformly disposed at the bottom of the shell, an elastic plungers is disposed at the bottom of the hanging rod, and the elastic plunger is matched with one of the plurality of positioning slots.

11. The weight-adjustable dumbbell according to claim 9, wherein two sides of an upper end of each of the plurality of dumbbell plates are respectively provided with a first upper hanging protrusion and a first upper hanging slot, two sides of a lower end of each of the plurality of dumbbell plates are respectively provided with a first lower hanging protrusion and a first lower hanging slot, and the first upper hanging protrusion and the first lower hanging protrusion are disposed on different sides of each of the plurality of dumbbell plates.

12. The weight-adjustable dumbbell according to claim 11, wherein an upper end of each of the fixing plates, on a side close to the plurality of dumbbell plates, respectively, is provided with a second upper hanging slot coupled with the first upper hanging protrusion, and a lower end of each of the fixing plates, on the side close to the plurality of dumbbell plates, respectively, is provided with a second lower hanging protrusion coupled with the first lower hanging protrusion.

13. The weight-adjustable dumbbell according to claim 9, wherein two sides of an upper end of each of the plurality of dumbbell plates are respectively provided with a first positioning hole and a third upper hanging slot, a first hanging member is detachably disposed inside the first positioning hole, two sides of a lower end of each of the plurality of dumbbell plates are respectively provided with a second positioning hole and a second lower hanging slot, a second hanging member is detachably disposed inside the second positioning hole, and the first hanging member and the second hanging member are disposed on different sides of each of the plurality of dumbbell plates.

14. The weight-adjustable dumbbell according to claim 13, wherein an upper end of each of the fixing plates, on a side close to the plurality of dumbbell plates, respectively, is provided with a third positioning hole, a third hanging member coupled with the third upper hanging slot is detachably disposed inside the third positioning hole, a lower end of each of the fixing plates, on the side close to the plurality of dumbbell plates, respectively, is provided with a third lower hanging slot coupled with the second hanging member.

15. The weight-adjustable dumbbell according to claim 1, wherein a plurality of positioning slots are uniformly disposed at the bottom of the shell, an elastic plungers is disposed at the bottom of the hanging rod, and the elastic plunger is matched with one of the plurality of positioning slots.

16. The weight-adjustable dumbbell according to claim 1, wherein two sides of an upper end of each of the plurality of dumbbell plates are respectively provided with a first upper hanging protrusion and a first upper hanging slot, two sides of a lower end of each of the plurality of dumbbell plates are respectively provided with a first lower hanging protrusion and a first lower hanging slot, and the first upper hanging protrusion and the first lower hanging protrusion are disposed on different sides of each of the plurality of dumbbell plates.

17. The weight-adjustable dumbbell according to claim 16, wherein an upper end of each of the fixing plates, on a side close to the plurality of dumbbell plates, respectively, is provided with a second upper hanging slot coupled with the first upper hanging protrusion, and a lower end of each of the fixing plates, on the side close to the plurality of dumbbell plates, respectively, is provided with a second lower hanging protrusion coupled with the first lower hanging protrusion.

18. The weight-adjustable dumbbell according to claim 1, wherein two sides of an upper end of each of the plurality of dumbbell plates are respectively provided with a first positioning hole and a third upper hanging slot, a first hanging member is detachably disposed inside the first positioning hole, two sides of a lower end of each of the plurality of dumbbell plates are respectively provided with a second positioning hole and a second lower hanging slot, a second hanging member is detachably disposed inside the second positioning hole, and the first hanging member and the second hanging member are disposed on different sides of each of the plurality of dumbbell plates.

19. The weight-adjustable dumbbell according to claim 18, wherein an upper end of each of the fixing plates, on a side close to the plurality of dumbbell plates, respectively, is provided with a third positioning hole, a third hanging member coupled with the third upper hanging slot is detachably disposed inside the third positioning hole, a lower end of each of the fixing plates, on the side close to the plurality of dumbbell plates, respectively, is provided with a third lower hanging slot coupled with the second hanging member.

* * * * *